United States Patent [19]

Courian

[11] Patent Number: 4,843,736

[45] Date of Patent: Jul. 4, 1989

[54] SANDAL

[76] Inventor: Curtis C. Courian, 4911-B Clairemont Dr., San Diego, Calif. 92117

[21] Appl. No.: 233,465

[22] Filed: Aug. 18, 1988

[51] Int. Cl.[4] ..... A43B 3/12

[52] U.S. Cl. ..... 36/11.5

[58] Field of Search ..... 36/11.5, 97, 50

[56] References Cited

U.S. PATENT DOCUMENTS

| | | | |
|---|---|---|---|
| 2,259,273 | 10/1941 | Smith | 36/11.5 |
| 3,063,166 | 11/1962 | Blavier | 36/11.5 |
| 3,275,002 | 9/1966 | Scholl | 36/11.5 X |
| 3,352,033 | 11/1967 | Colley | 36/11.5 |
| 4,200,997 | 5/1980 | Scheinhaus | 36/11.5 |
| 4,446,633 | 5/1989 | Scheinhaus | 36/11.5 |

FOREIGN PATENT DOCUMENTS

| | | |
|---|---|---|
| 441651 | 6/1936 | United Kingdom . |
| 560835 | 4/1944 | United Kingdom . |
| 2147792 | 10/1983 | United Kingdom . |

*Primary Examiner*—Donald Watkins

*Attorney, Agent, or Firm*—Cahill, Sutton & Thomas

[57] ABSTRACT

The sandal has a laminated sole comprising an inner sole and an outer sole, both formed of flexible cellular material. The inner sole is thicker, less dense and softer than the outer sole. A single retaining strap is employed which also is made of flexible and elastic cellular material and which has on its broad outer faces elastic stretch fabric material. The strap is in a figure eight configuration with its forward closed loop passing through a hole in the inner sole and out to the edge thereof through a slot in the under surface of the inner sole. The rear loop of the strap, which is formed by the free ends thereof, lies in a slot in the under surface of the inner sole just forward of the heel region of the sandal. The ends of the straps are affixed to the inner sole to hold them in place.

2 Claims, 1 Drawing Sheet

SANDAL

TECHNICAL FIELD

This invention is concerned with providing comfortable footwear in the form of a sandal.

BACKGROUND ART

Sandals have been around for a long time, probably since some early human decided to protect the soles of his or her feet from rough surfaces. Nevertheless, efforts to improve the sandal continue down to the present time.

A number of inventors have proposed to construct sandals by looping the retainer straps through openings and slots in the material forming the sole of the sandal. Representative examples of such sandals can be found in United Kingdom patent No. 441,651 granted Jan. 23, 1936 to the Hertfordshire Rubber Company for "IMPROVEMENTS IN OR RELATING TO BOOTS OR SHOES", United Kingdom patent No. 560,835 granted Apr. 21, 1944 to K. G. Freund for "IMPROVEMENTS IN OR RELATING TO ORTHOPAEDIC APPLIANCES", U.S. Pat. No. 4,200,997 granted May 6, 1980 to M. G. Scheinhaus et al. for "SANDAL", and United Kingdom patent application No. 2,147,792A published May 22, 1985 for S. E. Slaughter et al. for "FOOTWEAR". A significant deficiency of all of the sandals disclosed in these four patents is that they all employ substantially inelastic straps which must be adjustably buckled or otherwise adjustably fastened to fit the foot of the wearer. In efforts to reduce the discomfort likely to be experienced by a wearer of these sandals Hertfordshire, Scheinhaus et al. and Slaughter et al. all provide for relative movement between the straps and the soles of the sandals. The resulting sandals are fairly complex and expensive to produce. It is believed that none of these sandals has been particularly successful.

U.S. Pat. No. 3,063,166 granted Nov. 13, 1962 to P. Blavier for "SANDAL" recognized the problems associated with inelastic straps and proposed, among other things, that the straps be affixed to the sole of the sandal with short strips of elastic material. Blavier proposed that the real solution to the problem lay in attaching the rear ends of the straps to the sole at a single position beneath the foot and midway between the edges of the sole. Such an arrangement offers the opportunity for the wearer to experience considerable discomfort when standing on the ends of the straps.

There continued to be a need for a comfortable sandal which can be easily placed on and removed from the wearer's foot and which is inexpensive to produce.

DISCLOSURE OF THE INVENTION

This invention provides that the sandal comprise an inner sole and an outer sole, both formed of flexible cellular material. The inner sole is thicker, less dense, and softer than the outer sole. A single retaining strap is employed which is also made of flexible and elastic cellular material having its opposite broad faces covered with an elastic stretch fabric. The strap has a figure eight configuration with its forward, closed loop passing through a hole in the inner sole and out to the edge thereof through a slot in the under surface of the inner sole. The rear loop of the strap, which is formed by its free ends, lies in a slot in the under surface of the inner sole just forward of the heel region of the sandal. The ends of the strap are attached to the inner sole in the slot to hold them in place.

BRIEF DESCRIPTION OF THE DRAWING

The invention is described in greater detail hereinafter by reference to the accompanying drawing wherein.

BEST MODE FOR CARRYING OUT THE INVENTION

Figure 1:
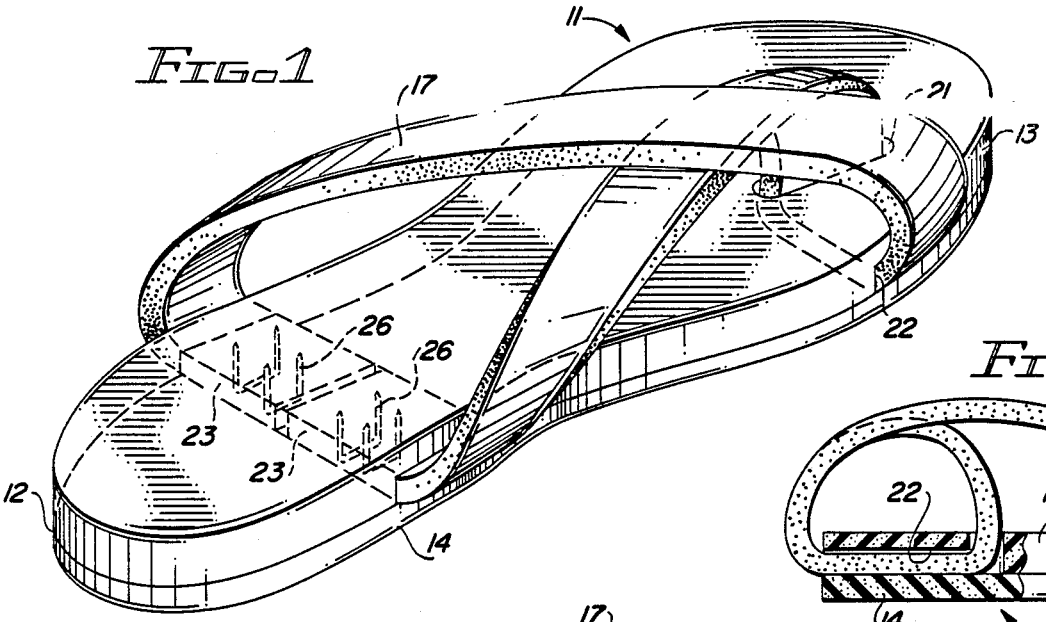
FIG. 1 is a perspective view from above of a sandal constructed in accordance with this invention.
Figure 5:
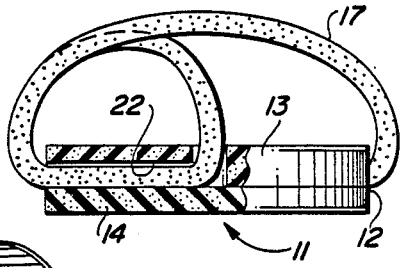
FIG. 5 is a front view of the sandal with a portion of the sole broken away to show the interior.
Figure 2:
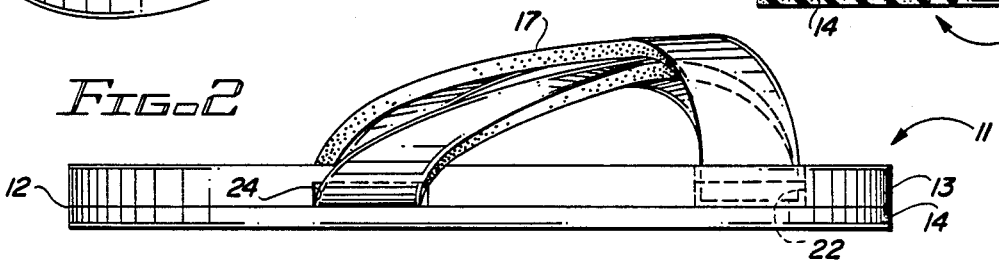
FIG. 2 is a side elevational view of the sandal.
Figure 6:
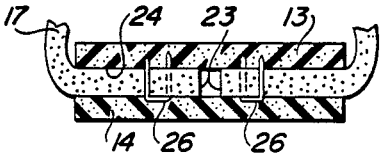
FIG. 6 is a vertical sectional view through the sandal taken generally as indicated by line 6—6 in FIG. 4.

Referring particularly to FIGS. 1, 2 and 5, the sandal, indicated generally by reference numeral 11, has a laminated sole 12 comprised of an upper, or inner, sole 13 and a bottom, or outer, sole 14.

Figure 4:
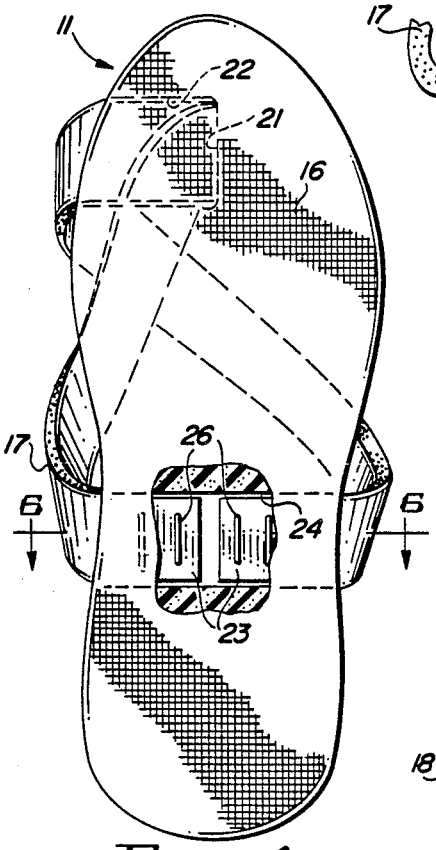
FIG. 4 is a bottom view of the sandal with a portion of the sole broken away to show the interior.

Both the inner sole 13 and the outer sole 14 of the sandal sole 12 are formed of flexible cellular material, such as, for example, foam rubber or foam polyurethane plastic material. These sole laminates however differ in density and compressibility. Inner sole 13 serves primarily to cushion the foot of the wearer and therefore is made from a fairly low density, compressible, and elastic foam material. Outer sole 14, which serves as a wear surface for the sandal, is a more dense, less compressible material. In the interest of economy inner sole 13 and outer sole 14 can both be made from identical starting materials. For example, a typical sandal might employ an inner sole 13 of urethane foam material having a thickness of approximately one half inch. A similar piece of foam can be compressed under heat and pressure to reduce its thickness to approximately three sixteenths of an inch to produce the more dense wear resistant outer sole 14. Outer sole 14 also preferably has molded into the bottom surface thereof a roughened, non-skid pattern such as that indicated at 16 in FIG. 4 which shows the bottom of the sandal.

The inner sole 13 and outer sole 14 of sole 12 have identical planar patterns generally of the configuration of the outline of a human foot. Outer sole 14 is affixed to inner sole 13 by means of a suitable adhesive as the final assembly step in the manufacture of the sandal. Prior to that step a retaining strap 17 is affixed to the inner sole 13.

Figure 7:
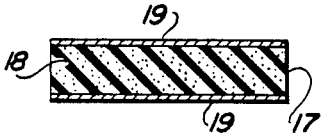
FIG. 7 is a sectional view through the retaining strap of the sandal taken generally as indicated by line 7—7 in FIG. 3.

Retaining strap 17 has a core 18 consisting of an elongated strip of soft, compressible, elastic cellular material, similar to the material from which the inner sole 13 is made. The opposite broad faces of the strap core 18 are covered by a stretch fabric indicated at 19 (see FIG. 7). The fabric cover for strap 17 is preferably a knit jersey fabric made from synthetic thermoplastic polyamide plastic fibers, such as nylon. Fabrics of that type have a great deal of stretch, yet retain their body and have good wear and soil resistance characteristics. The functional purpose of the fabric 19 covering strap 17 is twofold. It, first, facilitates putting the sandal on and taking it off because the fabric slides more easily over the skin of the wearer then does the cellular material from which the core of the strap is made. Secondly, the fabric generally is more comfortable against the skin than is plastic or rubber foam material. The fabric cover 19 can also serve a decorative function through the selection of striking colors for the fabric.

Figure 3:
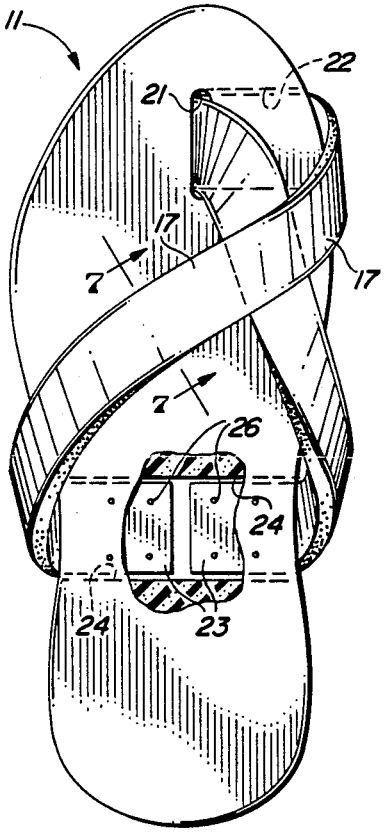
FIG. 3 is a top view of the sandal with a portion of the sole broken away to show the interior.

Retaining strap 17 is formed as a single elongated strip which is twisted into a figure eight configuration as best shown in FIGS. 1 and 3. The forward, closed loop of the figure eight attaches to the toe region of sole 12 of the sandal by passing through an opening 21 in inner sole 13 in that region of the inner sole which is just beneath the inside surface of the big toe of the wearer. This closed forward loop of retaining strap 17 passes from opening 21 through a transverse slot 22 formed in the under surface of inner sole 13 beneath the region of the inner sole on which the big toe of the wearer is placed.

The rear loop of retaining strap 17 is provided by the free ends 23 of the strap. These ends 23 are disposed in a transverse slot in the under surface of inner sole 13. Transverse slot 24 is located just ahead of the region normally occupied by the heel of the wearer on the upper surface of inner sole 13.

Assembly of the strap 17 is completed by means for fastening the ends 23 of strap 17 to the inner sole 13. This fastening means can take the form of staples, indicated at 26, which are driven upwardly through the ends 23 of strap 17 into the body of inner sole 13. If desired, a suitable adhesive can also be employed to affix the ends 23 of strap 17 to the inner sole 13. As mentioned previously, the assembly of the sandal is completed by adhesively adhering outer sole 14 to inner sole 13.

From the foregoing it should be apparent that this invention provides an inexpensively constructed sandal offering a maximum degree of comfort and ease of use to the wearer.

What is claimed is:

1. A sandal comprising an inner sole having a top and an under surface, said inner sole being made from a flexible and compressible cellular material, an outer sole, said outer sole having a thickness less than said inner sole and being made from a flexible material having a density greater than the material of said inner sole, said inner sole having an opening therethrough in the vicinity of the region which is beneath the inside of the big toe of a wearer of the sandal, said inner sole having a transverse slot in the under surface thereof extending from said opening, beneath the big toe region thereof to the outer transverse edge of the inner sole, said inner sole further having a second transverse slot in the under surface thereof ahead of the region occupied by the heel of the wearer, said second transverse slot extending from edge to edge of the inner sole, a retaining strap comprising an elongated strip of flexible and compressible cellular material having stretch fabric material covering the broad faces thereof, said strap being formed into a generally figure eight configuration with the forward closed loop portion thereof extending through said opening and the transverse slot communicating therewith, the rear open loop of the strap formed by the ends thereof entering opposite ends of said second slot, means for securing the ends of said strap to said inner sole, and means for securing said outer sole to said inner sole.

2. The sandal of claim 1 further characterized in that the fabric material covering said strap is a nylon jersey knit.

* * * * *